US008438985B2

(12) United States Patent
Scadden

(10) Patent No.: US 8,438,985 B2
(45) Date of Patent: May 14, 2013

(54) UNITARY TWIN PONTOON HULL FLOAT BOAT

(76) Inventor: Dave Scadden, Liberty, UT (US)

( * ) Notice: Subject to any disclaimer, the term of this patent is extended or adjusted under 35 U.S.C. 154(b) by 587 days.

(21) Appl. No.: 12/288,157

(22) Filed: Oct. 17, 2008

(65) Prior Publication Data

US 2010/0095877 A1 Apr. 22, 2010

(51) Int. Cl.
*B63B 1/12* (2006.01)

(52) U.S. Cl.
USPC ..... 114/61.25; 114/345; 441/130; 441/132

(58) Field of Classification Search ..... 114/61.25, 114/345, 354; 441/40, 129, 130, 132
See application file for complete search history.

(56) References Cited

U.S. PATENT DOCUMENTS

| | | | | |
|---|---|---|---|---|
| 6,168,489 | B1 * | 1/2001 | Huston | 441/130 |
| 6,343,560 | B1 * | 2/2002 | Myers | 114/61.25 |
| 6,749,475 | B2 * | 6/2004 | Howerton | 441/132 |
| 6,929,521 | B2 * | 8/2005 | Howerton | 441/132 |
| 7,530,321 | B2 * | 5/2009 | Dingel et al. | 114/345 |

* cited by examiner

*Primary Examiner* — Lars A Olson

(57) ABSTRACT

A "float boat" with a unitary twin pontoon hull comprising a pair of inflatable pontoons, each shaped, when inflated to have a fully curved rocker bottom surface and a substantially straight upper surface and with pontoons being interconnected at rigid ends by an inflatable transom that together with the pontoons forms a raised V-hull stern; a platform extending between the pontoons and adjacent to the transom and at least one foot rest for a user sitting on the platform.

5 Claims, 9 Drawing Sheets

UNITARY TWIN PONTOON HULL FLOAT BOAT

CROSS-REFERENCE TO RELATED APPLICATIONS

Figure 1:
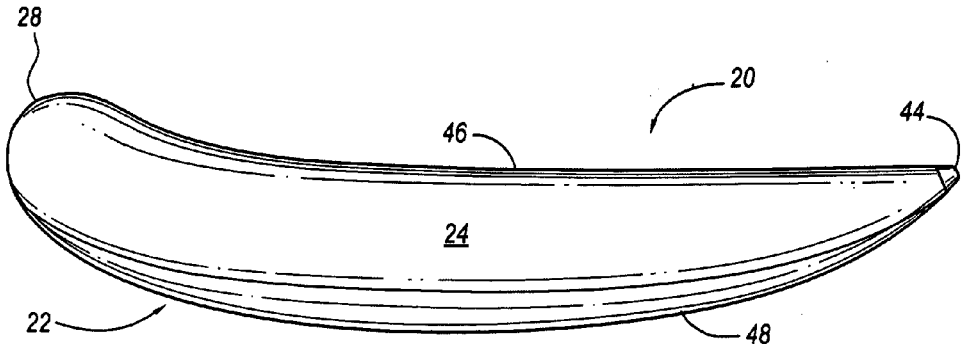

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

1. Field of the Invention

This invention relates to pontoon craft and particularly to such craft as are commonly referred to as "float boats". Lightweight pontoon boats of the type known generally as float boats, with inflatable pontoons have become increasingly more popular for use by fishermen and others. Float boats are smaller and lighter in weight than many other types of watercraft and are more easily handled, even by a single individual during launching, retrieval and use on water.

Float boats are often propelled using oars, or by kicking of the wader covered feet of a user, or by both feet movement and oar operation. Some float boats can even b powered by light weight outboard motors.

2. Prior Art

Existing float boats generally include a pair of spaced apart inflatable pontoons interconnected by a rigid platform structure. The pontoons are air filled and usually constructed as reinforced, rubberized tubes, with central straight pontoons having upturned front and rear ends.

The rigid platform structure supports a chair, including a seat upon which a user sits and a seatback for supporting the back of a user.

Oar locks are provided at opposite sides of the chair to receive oars used to control the boat during operation.

More recently, the rigid platform structure includes a sliding standing deck that will slide beneath the chair for storage and that will pull out from beneath the chair to provide a surface upon which a boat user may stand. A support rail may be provided at the front of the stand-up deck to serve as a support and safety rail for a boat user standing on the stand-up deck. With the stand-up deck positioned beneath the chair, the user can, if desired, propel and direct the boat using his legs hanging into the water.

BRIEF SUMMARY OF THE INVENTION

Objects of the Invention

Principal objects of the present invention are to provide a unitary twin pontoon float boat hull that is very lightweight, easily compacted for carrying and storage, while opening and inflating to become a full sized operable float boat.

Other objects are to provide a unitary twin pontoon float boat hull that will readily convert from a very lightweight compact boat without a standing deck and safety bar to a lightweight float boat including an inflatable load platform and/or to a float boat, including a standing deck and safety bar, and further to a float boat with a rigid support frame, a seat, a pullout standing deck, and a safety bar.

Still another object is to provide a unitary twin pontoon float boat with a hull having a rocker bottom that will, regardless of which seating and/or standing structure may be associated with a unitary twin pontoon hull, or of the position, type, or amount of boat loading, insure improved boat handling and maneuverability during use.

Another object is to provide a unitary twin pontoon hull float boat that uses an inflatable transom to increase the load capability of the boat, securement of a load on the boat, and water deflection during use.

Features of the Invention

Principal features of the invention include a unitary twin pontoon inflatable hull that in itself serves as a lightweight float boat having a pair of stern connected, spaced apart inflatable pontoons. The hull includes a seat, a foot rest, a seat back and holder for oars.

Adding a lightweight standing deck and a safety bar provides a lightweight, easily transported float boat in which a fisherman can sit, or stand, during boat travel.

The unitary twin pontoon hull further accommodates a rigid frame that, when installed on the hull, will provide a float boat with a rigid seat, a standing deck that will slide from a storage position beneath the seat to a user position forward of the seat, and a pivoted safety bar movable between a stowed position behind the seat and a use position that is forwardly of the seat and above the standing deck when the deck is pulled from storage beneath the seat to a user position forward of the seat.

The unitary, spaced apart inflatable pontoons extend parallel to one another from front, upturned bow tips to upturned stern ends that are interconnected by a common inflatable transom having a generally U-shaped configuration. The transom may provide a rear seat back for an inflatable platform extending between the pontoons and forwardly of the inflatable transom. The transom extends above the top surfaces of the pontoons to also serve as a deflector for water splashing against the stern of the boat and that acts with the pontoons to serve as a V-hull for the boat, regardless of the direction of travel of the boat.

The inflatable platform may be formed separately from the unitary, spaced apart pontoons and be removably positioned between the pontoons for use. Alternatively, the inflatable platform is formed as an integral part of the pontoons and transom and is inflated in common with the pontoons and the transom.

The interconnected inflatable pontoons each include a substantially straight upper surface and a continuously convexly curved bottom surface. The convex curvature of each bottom surface extends upwardly into the bow tips of the pontoons and upwardly into the transom. The transom is inflatable with the pontoons, extends upwardly from rear-most ends of the pontoons and spans the distance between pontoons. A bottom of the transom extends between the bottom surfaces of the spaced apart pontoons, from rear ends of the pontoons, upwardly and rearwardly from the upwardly curved bow tips and into a rearwardly extending curved central rear projection of the transom that forms the stern of the boat.

An interior face of the inflated transom extends from above the upper surfaces of the pontoons, downwardly between the pontoons, to the bottom of the inflatable transom. The transom thus forms an upwardly extending seat back and/or splash deflector and/or load retainer for the boat, in addition to interconnecting the rear ends of the pontoons.

A rigid foot rest bar has opposite ends suspended from connectors formed on the pontoons, or otherwise removably connected, and extends between the pontoons so that a user sitting on the inflated platform, (whether a built-in inflatable platform, or a suspended, inflatable platform), or on a seat fixed above an inflatable platform, can rest his feet on the foot rest bar.

The twin pontoon hull comprising the spaced apart inflatable pontoons, with fully curved bottoms, and interconnecting inflatable transom and inflatable platform, with the addition of the removable foot rest bar becomes a very lightweight, easily transported float boat, for use by a fisherman, or the like. Such a float boat is readily transported while deflated and compacted by back-pack, ground vehicle, water craft and aircraft. Even while fully inflated the very lightweight float boat is readily carried manually or by vehicle, including off-highway vehicles, including motorcycles and the like.

As noted, the boat hull also readily accommodates additional components to make a lightweight float boat that will allow a fisherman to safely sit or stand, while using the boat.

A rigid seat suspended between the spaced apart pontoons can also be used as a standing deck for the user. A safety support bar attached to the rigid seat or independently suspended from the pontoons can be pivoted from a stowed position to a use position forwardly of and elevated above, the seat when a user stands on the rigid seat while fishing, or the like.

Alternatively, a rigid frame including a seat for a user, a pull out, stand-up deck, and a safety support bar pivotable between a stowed position behind the seat and a use position above and forward of the seat and above the deck can be suspended between and supported by the pontoons of the unitary twin pontoon hull to form a float boat.

Additional objects and features of the invention will become apparent to persons skilled in the art to which the invention pertains from the following detailed description and claims.

BRIEF DESCRIPTION OF THE FIGURES OF THE INVENTION

In the Drawings

Figure 2:
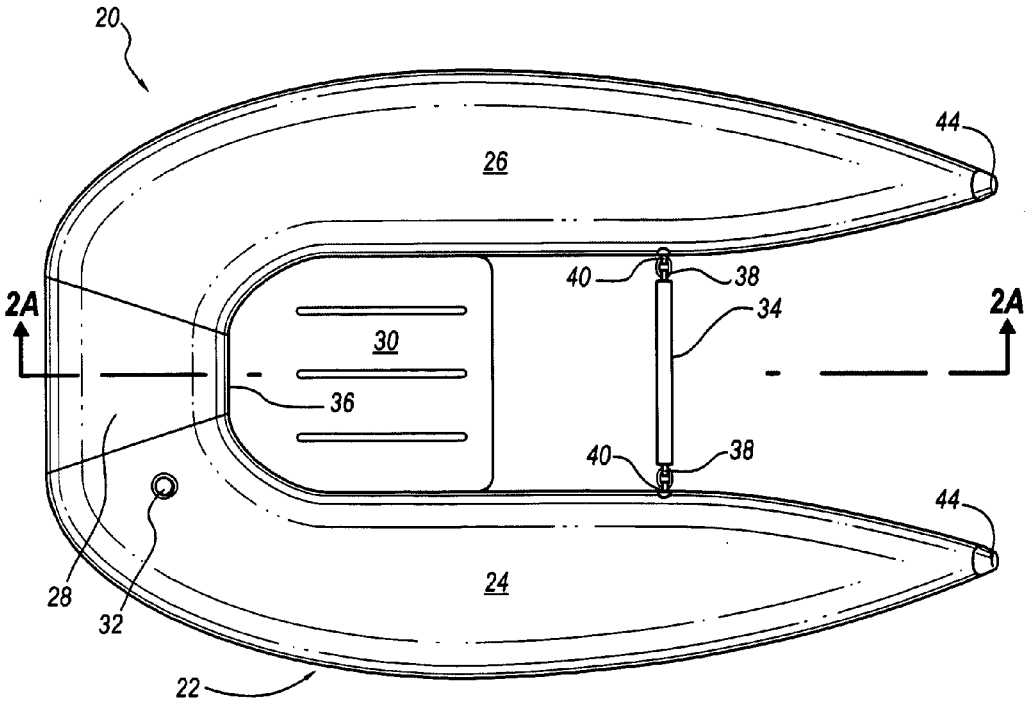
Figure 2A:
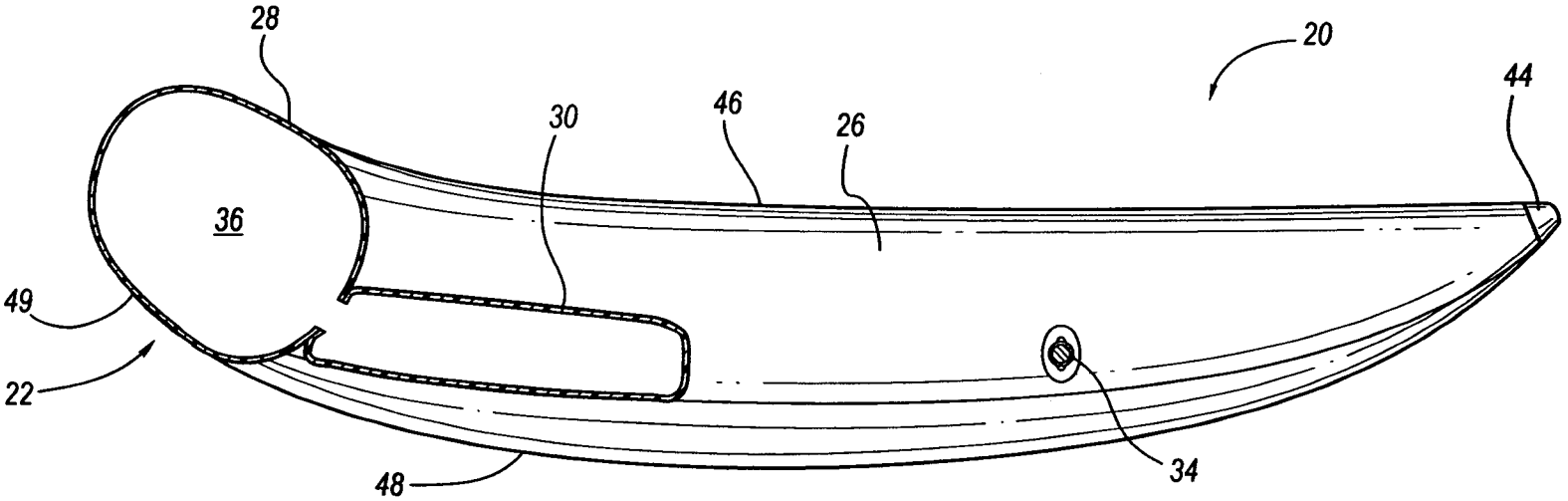
Figure 3:
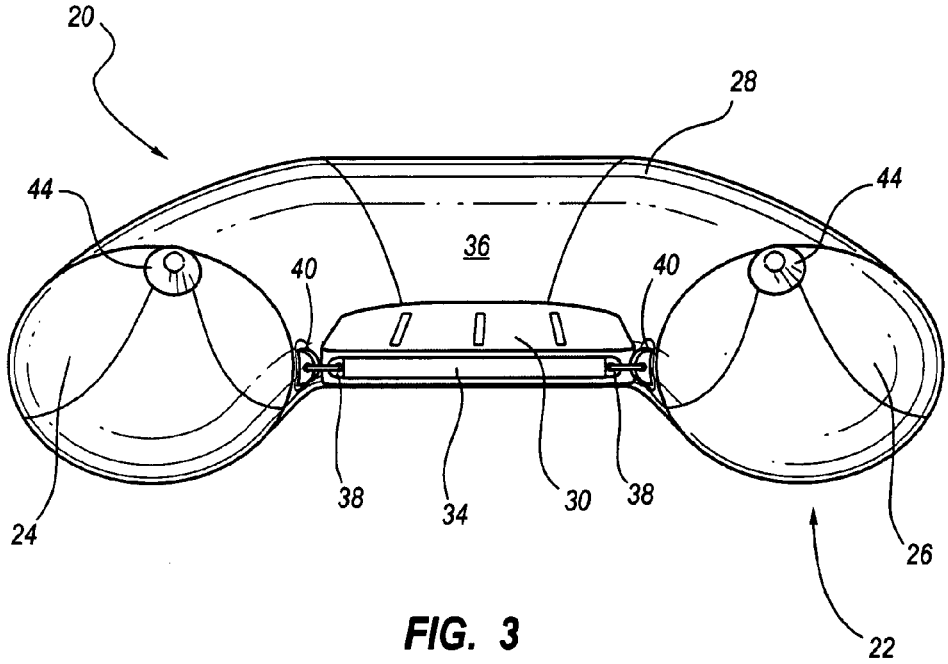
Figure 4:
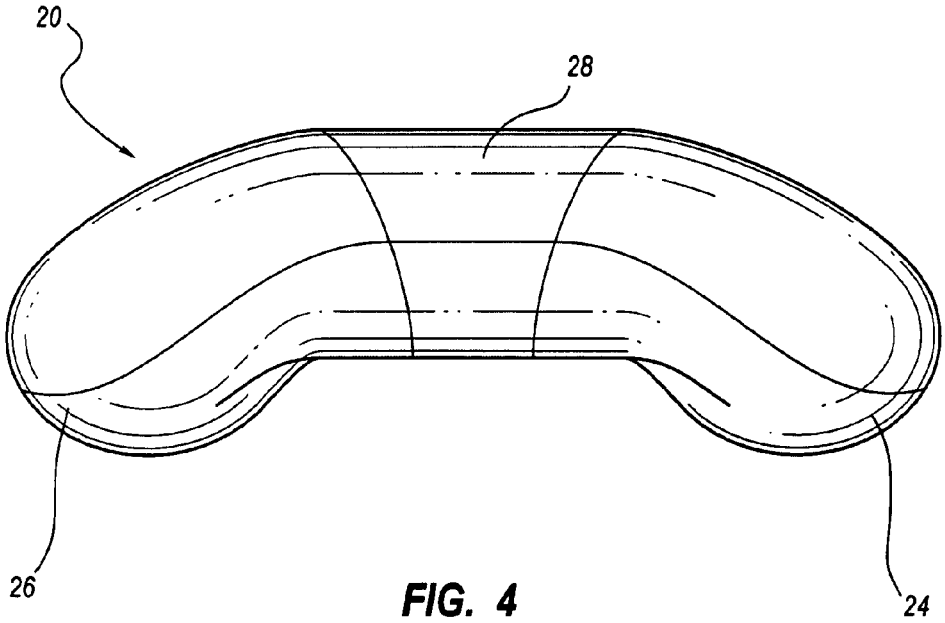
Figure 5:
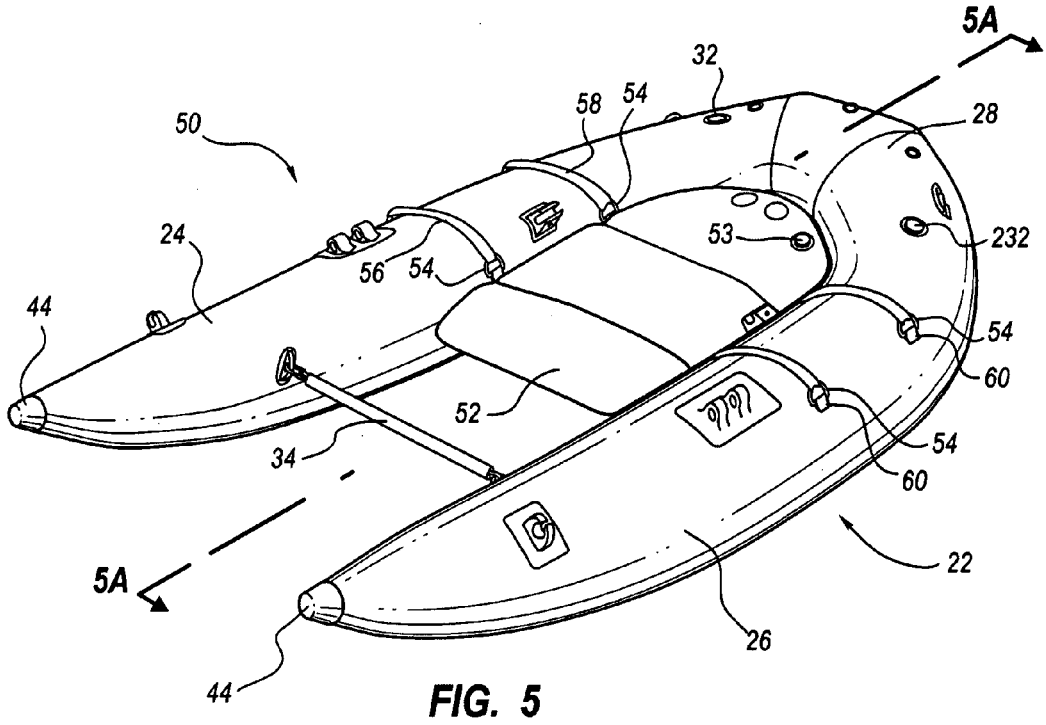
Figure 6:
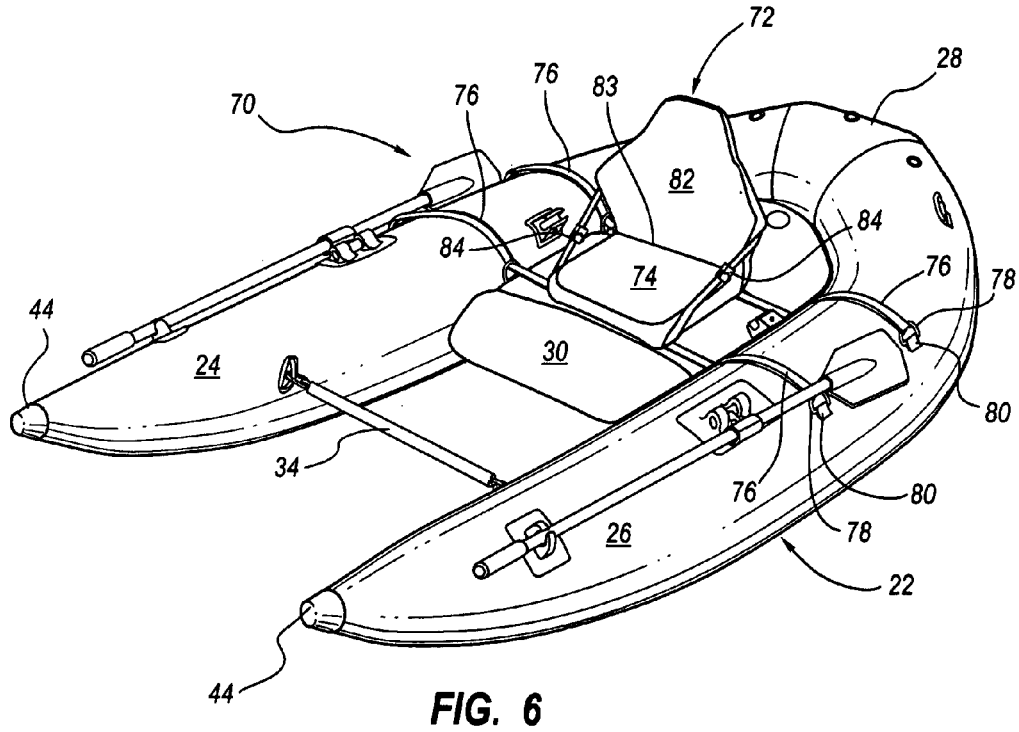
Figure 5A:
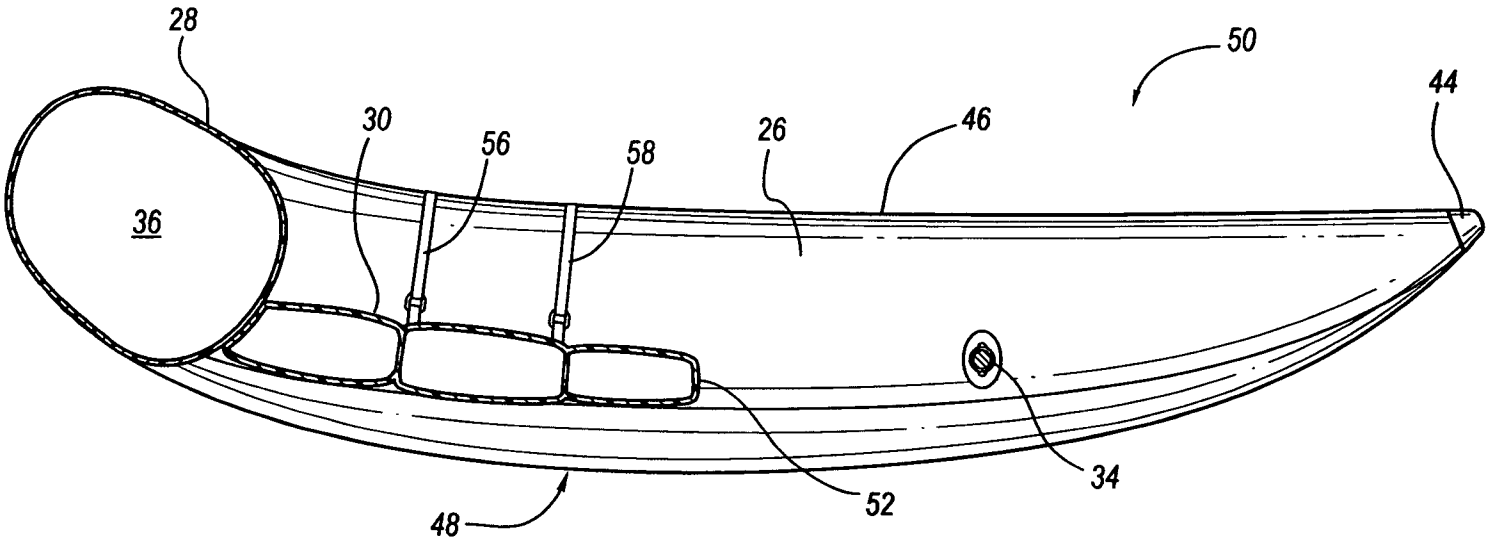
Figure 7:
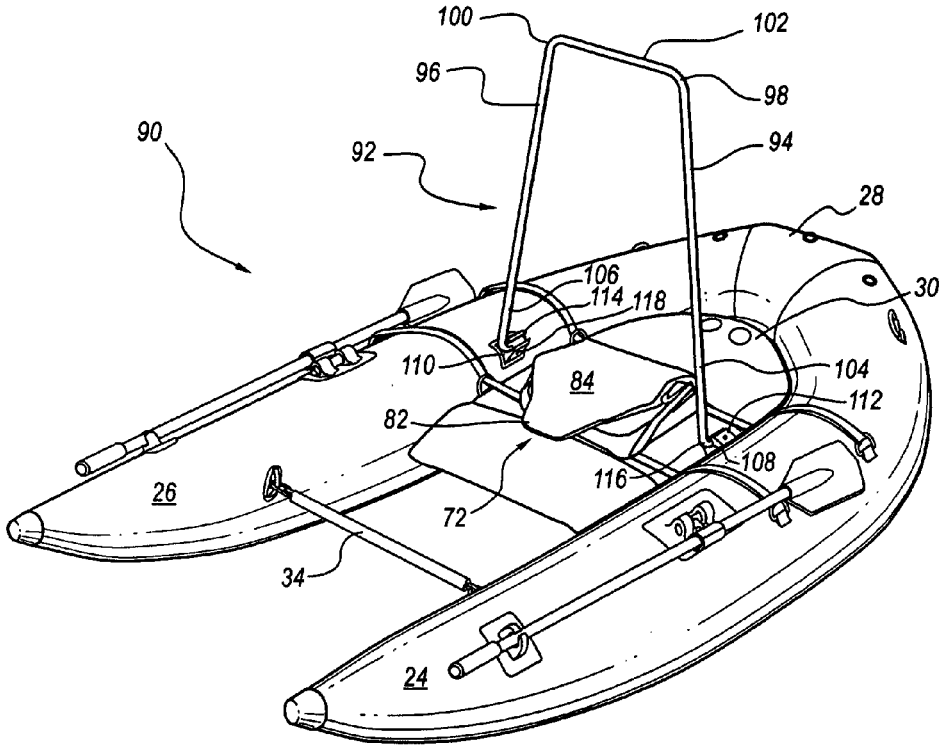
Figure 8:
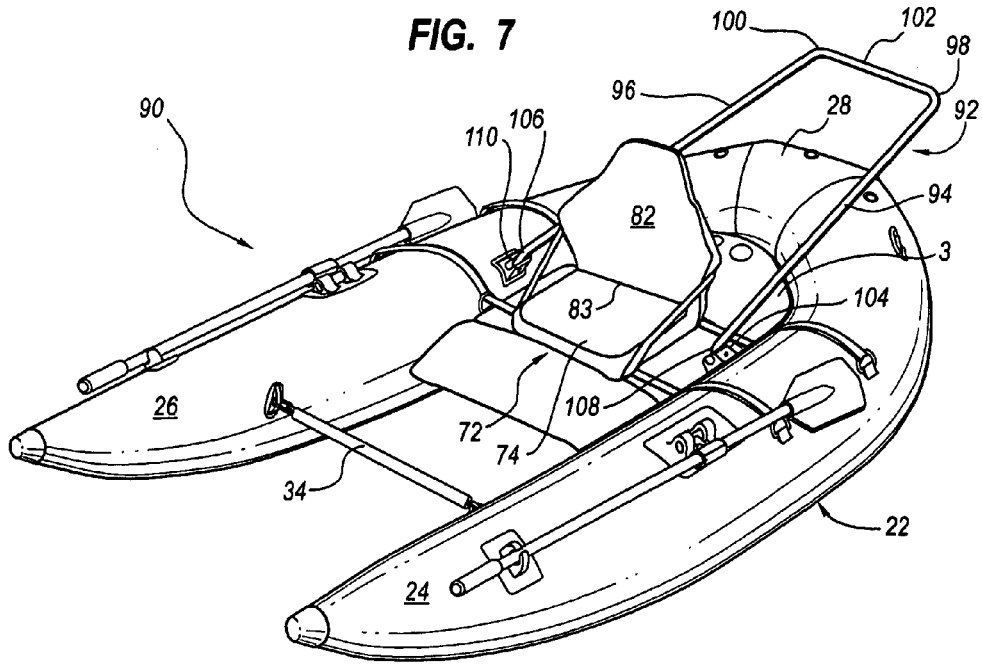
Figure 9:
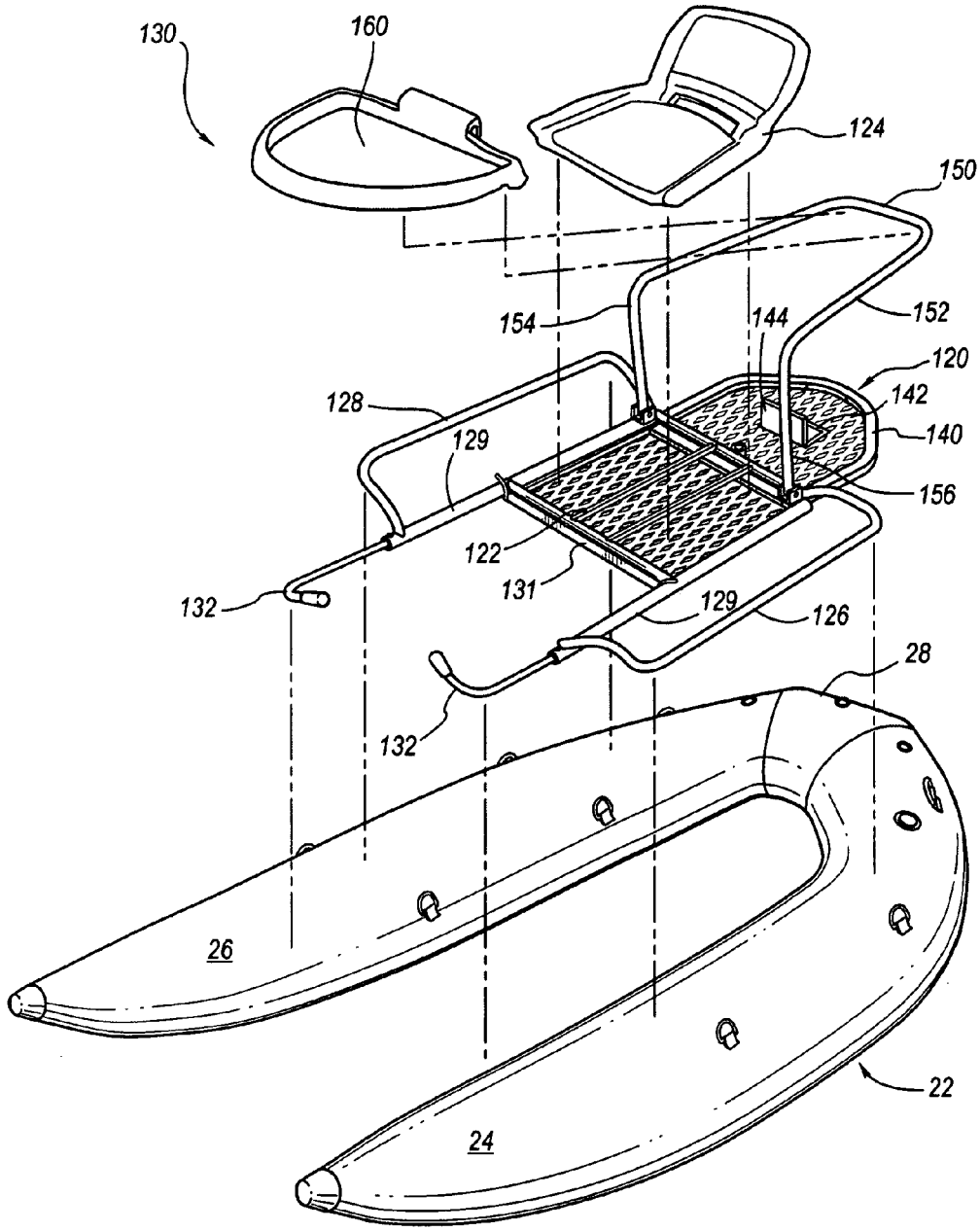
Figure 10:
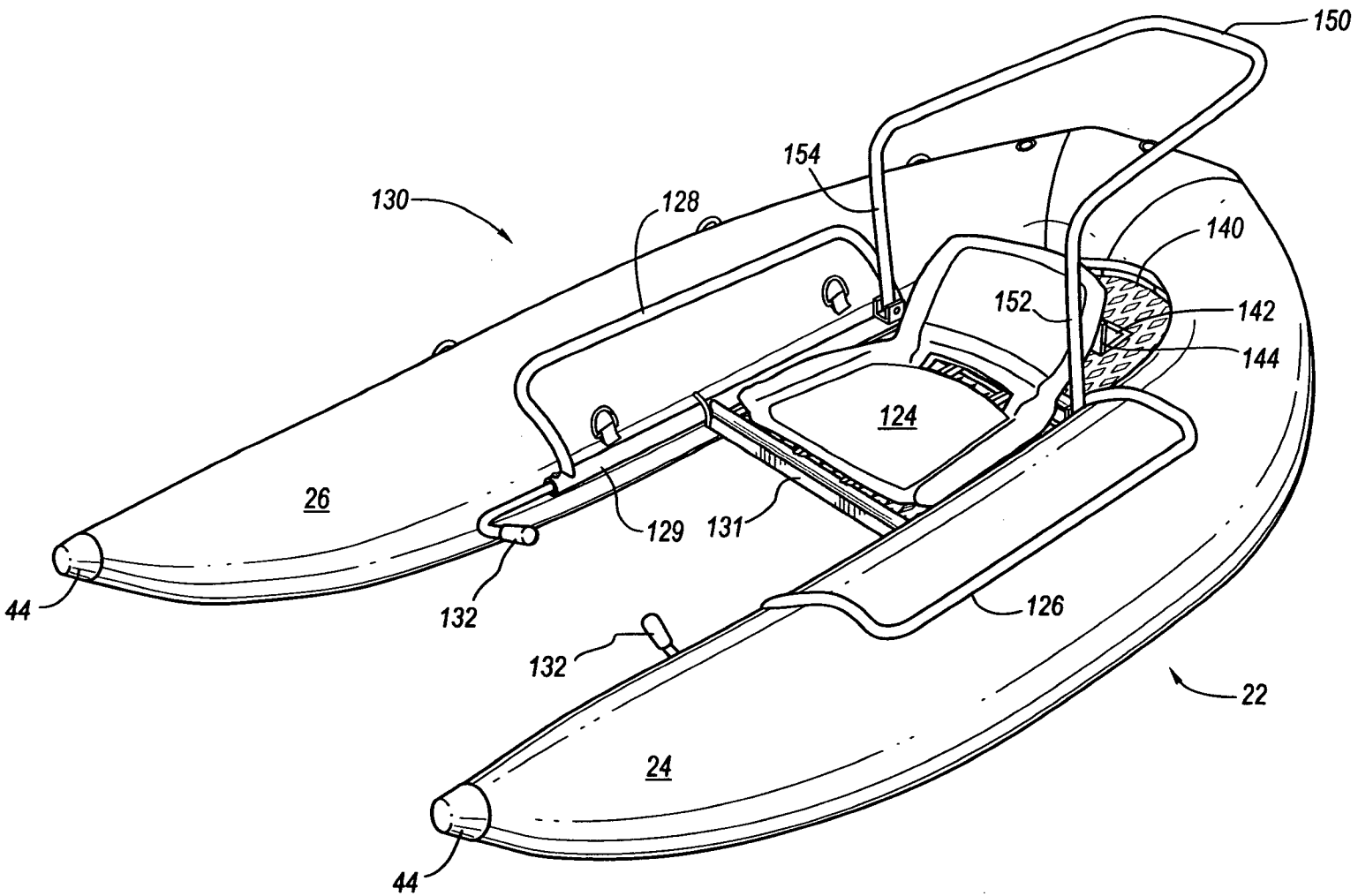
Figure 11:
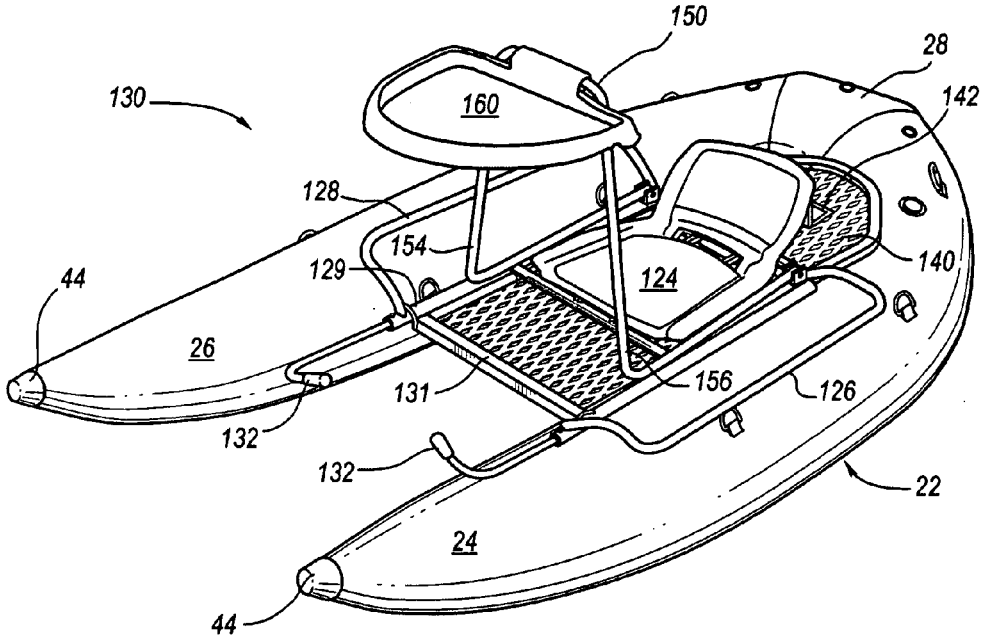
Figure 12:
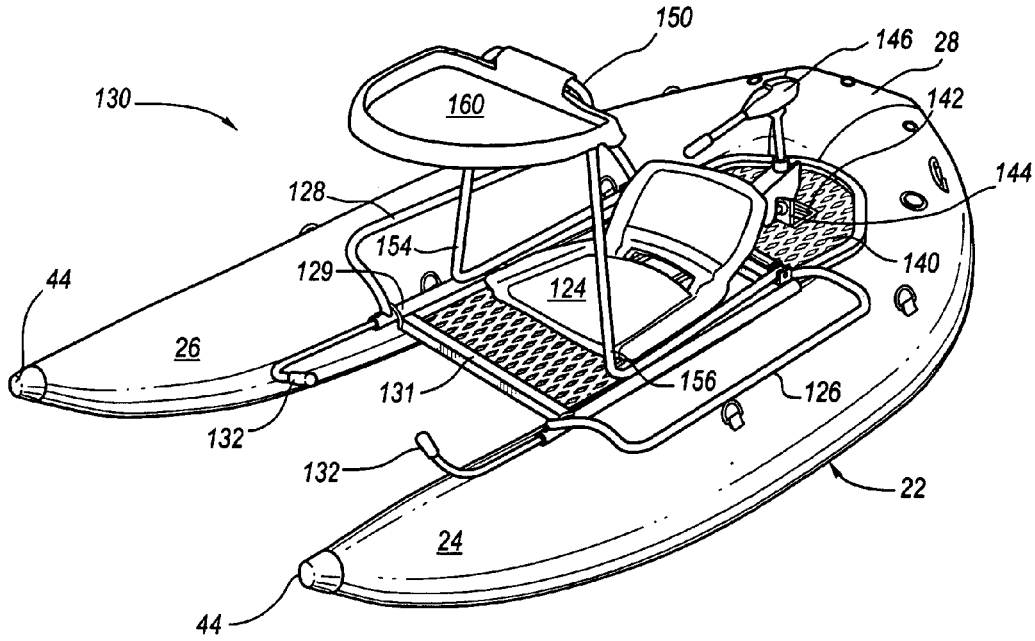

FIG. 1 is a side elevation view of the hull of the float boat of the invention;

FIG. 2, a top plan view of the hull including an integral inflatable load platform and a foot rest bar to make a very lightweight float boat;

FIG. 2A, a longitudinal section taken on the line 2A-2A of FIG. 2;

FIG. 3, a front elevation view of the float boat of FIG. 2;

FIG. 4, a rear elevation view;

FIG. 5, a perspective view taken from above a bow end of a float boat having a separately inflated load platform positioned between pontoons;

FIG. 5A, a longitudinal section, taken on the line 5A-5A of FIG. 5;

FIG. 6, a perspective view of a lightweight float boat showing a fold down seat suspended to rest on the inflatable load platform;

FIG. 7, a perspective view like that of FIG. 6, showing a suspended, fold down seat on the load platform and including a support bar, the support bar being shown in a use position and the seat back shown folded down;

FIG. 8, a view like that of FIG. 7, but showing the support bar in a stowed position and the seat back raised;

FIG. 9, an exploded perspective view of the float boat showing the hull and a rigid frame having a seat, a sliding standing deck and a support rail pivotable between a stowed position and a use position and a rigid load platform;

FIG. 10, a perspective view of the float boat as shown in FIG. 9 with assembled hull and rigid frame; and FIGS. 11 and 12, are similar views, showing a motor secured to a motor mount on the rigid load platform.

DETAILED DESCRIPTION

Referring Now the Drawings

In the illustrated preferred embodiments of FIGS. 1-4, the very lightweight float boat of the invention, shown generally at 20 includes a unitary twin pontoon hull 22 comprising a pair of spaced apart parallel extending inflatable pontoons 24 and 26, interconnected at one end by an inflatable transom 28.

Boat 20 further includes an inflatable platform 30 that extends between the spaced apart inflatable pontoons 24 and 26, intermediate the lengths of the pontoons and adjacent the transom 28 at the stern of the boat. The pontoons 24 and 26, transom 28 and platform 30 are all made from durable flexible materials, such as reinforced neoprene rubber, that can inflate to the required shapes. Preferably the pontoons and transom and the platform are interconnected to be air filled through a single conventional air valve 32. It will be apparent, however, that the floats, transom and platform can also be interconnected, but air filled through separate air valves, or combinations of air valves.

Boat 20 also includes a rigid foot seat bar 34 that is releasably secured between pontoons 24 and 26, forwardly of the platform 30. A user of the boat, sitting on inflated platform 30 can rest his feet on foot seat bar 34 and may rest his back against a front wall 36 of transom 28.

While the ends of the foot seat bar 34 can be releasably secured to the pontoons in a wide variety of ways, a typical securement may include D-rings 38 connected into the ends of the bar 34 and suspended from hooks 40 bonded to inner side walls of the pontoons.

Foot rest bar 34 can be disconnected from one or both pontoons 24 and 26 and the pontoons, transom 28 and platform 30 can be deflated to allow the very lightweight boat to be compacted and put in a bag (not shown) for storage and travel. Inflation of the pontoons, transom and platform and attachment of the foot rest then makes the boat 20 ready for use on water. A user's feet, paddles, or oars, (not shown) can be used to propel and control direction of travel of the boat 20.

Each of the pontoons 24 and 26 has a front bow tip 44, a substantially straight top surface 46 extending from the tip 44 rearwardly to the transom 28; a fully curved bottom surface 48 that is convexly curved downwardly from the bow tip 44, continually convexly curved downwardly to a lowermost point and then continually convexly curved upwardly to the transom 28. The continuous curvature of bottom surface 50 insures a lowermost point regardless of boat loading that may tip the boat forwardly or rearwardly. Thus, if the boat is loaded heavier closer to the bow tips 4, and is tipped forwardly, or if loaded heavier towards the stern and therefore tipped rearwardly, the pontoons 24 and 26 will still have a lowermost point in the water about which the boat will pivot as the boat is maneuvered to port or aft while traveling forward or rearwardly.

Inflatable transom 28 extends between and connects the pontoons 24 and 26 at the stern of the boat and has a bottom surface 48 that continues the upward curves of the pontoons to be above the top surfaces of the pontoons. The transom provides a generally U-shaped configuration to the stern.

The very lightweight float boat 50 FIG. 5, of the invention includes the unitary twin pontoon hull 22, with spaced apart parallel inflatable pontoons 24 and 26 interconnected by the inflatable transom 28. Boat 50 also includes a rigid foot rest bar 34 removably secured between the pontoons 24 and 26 and an inflatable platform 52 positioned between the pontoons 24 and 26, and adjacent to transom 26. Platform 52 is inflated separately from hull 22 using conventional air valve 53. Rings 54 on the ends of front and rear straps 56 and 58, attached to opposite sides of platform 52 are looped over hooks 60 bonded to the pontoons 24 and 26 to support the platform 52.

The lightweight boat 70, FIG. 6 includes the unitary twin pontoon hull 22, with spaced apart, parallel inflatable pontoons 24 and 26 interconnected at the stern of the boat by inflatable transom 28. Boat 70 also includes a rigid foot rest bar 34 removably secured between the pontoons 24 and 26 and an inflatable platform 30.

A seat 72 having a rigid flat base 74 rests on a leading edge of platform 30 and is suspended by straps 76 fixed to the base 74 and connected by rings 78 to hooks 80 that are bonded to the pontoons. A rigid seat back 82 is hinged at 83 to the seat base and hinged braces 84 at opposite sides of the seat lock the seat back in a raised user back support position and are released to allow the seat back to pivot flat against the seat base. With seat back 82 flat against the seat base 74, the rear surface 84 of the seat back becomes a standing platform on which a boat user can stand while fishing, or the like.

As shown in FIGS. 7 and 8, the lightweight boat 90 is like the lightweight boat 70, but further includes a pivoted support bar 92. Support bar 92 includes a pair of legs 94 and 96 interconnected at ends 98 and 100 by a safety bar 102. The other ends 104 and 106 of legs 94 and 96 are bent to form leg extension 108 and 110. The extensions 108 and 110 are pivotally connected at 112 and 114, respectively to inner sides of the pontoons 24 and 26. Stops 116 and 118 on the sides of the pontoons limit pivoting of the support bar 92 towards the bow of the boat so that the safety bar is positioned forward of and above seat 72. The safety bar 102 serves as a lean bar and can be grasped by the boat user standing on the back surface of folded down seat back 82. Alternatively, the support bar 92 can be pivoted to a stowed position (FIG. 8) wherein the safety bar 102 is above the transom 28 and out of the way of a boat user sitting on seat 72.

Equipment and other cargo, now shown, may be carried on the portion of platform 30, extending between the seat 72 and the transom 28.

A rigid frame 120, FIGS. 9-12, of the type shown in U.S. Pat. No. 7,096,817, can also be used with the unitary twin pontoon hull 22.

As shown, boat 130, includes the rigid frame 120 with a seat support frame 122 on which a seat 124 is mounted. Hangers 126 and 128 project from parallel, spaced apart opposite side rails 129 of the frame 120 to curve over the pontoons 24 and 26, and to mount the frame to the pontoons. Straps (not shown) can be used to tie the hangers to the pontoons, if desired.

A rigid deck 131 is stowed under the seat support frame 122 and is mounted to slide between a stowed position beneath the seat 124 placed on seat support frame 122 and a use position pulled from beneath the seat 124. In the stowed position, a boat user's feet can extend into the water for use in propelling and/or maneuvering the boat, or can be rested on individual feet rests 132 for projecting from side rails 129. With the rigid deck 130 pulled from beneath the frame, a user can stand on the deck while fishing, or the like.

Rigid frame 120 further includes a rigid platform 140 extending rearwardly from the seat support frame and positioned between the pontoons 24 and 26 and between transom 28 and the seat 124 when the rigid frame 120 is positioned on the hull 22.

Rigid platform 140, which preferably is made of a suitable metal, or plastic mesh to allow water to drain through has a motor shaft opening 142 formed behind the seat and a motor support bracket 144 behind the seat, on which a lightweight motor 146 is secured, if desired. The motor 146, shown then has a shaft 134 extending downwardly through the opening 142 so that the propeller of the motor (not shown) is positioned between the pontoons 24 and 26 and below water level.

Equipment and other cargo can be carried on the rigid platform 140.

Rigid frame 120 is mounted on pontoons 24 and 26 and a support rail 150 has angled legs 152 and 154 pivotally connected at 156 to frame 120 such that the rail 150 will pivot between a stowed position behind a user sitting in seat 124 and a use position forward of the user when the user is sitting on seat 124, or standing on deck 130.

A tray 160 may be snapped onto support rail 150, if desired, to provide a place for a user to place fishing gear, or other items.

Although a preferred embodiment of my invention has been herein described, it is to be understood that the present disclosure is by way of example and that variations are possible without departing from the subject matter coming within the scope of the following claims, which subject matter I regard as my invention.

I claim:

1. A unitary twin pontoon bull float boat comprising a unitary twin pontoon hull including a pair of inflatable pontoons, each said pontoon having a front end and a rear end, a substantially straight top surface, a fully curved rocker bottom surface, said top and bottom surfaces extending from said front ends of said pontoons to rear ends of said pontoons;

a transom being inflatable with said pontoons; and an inflatable platform, said platform formed integral and inflatable with the pontoons and transom.

2. A unitary twin pontoon hull float boat comprising a unitary, twin pontoon hull including a pair of inflatable pontoons, each said pontoon having a front end and a rear end, a substantially straight top surface, a fully curved rocker bottom surface, said top and bottom surfaces extending from said front ends of said pontoons to rear ends of said pontoons;

an inflatable transom interconnecting said rear ends of said pontoons, said transom being inflatable with said pontoons and said transom including a rear most stern and a rear surface extending downwardly to the curved rocker bottoms of the pontoons and a rear inner face extending from above the tops of the pontoons and downwardly below a top surface of a platform;

a seat having a seat base and a seat back positioned on said platform;

a safety bar; and means pivotally mounting the safety bar to said pontoons whereby the safety bar is pivoted between a stored position behind the seat and a position above and forwardly of said seat.

3. A unitary twin pontoon hull float boat comprising a unitary twin pontoon hull including a pair of inflatable pontoons, each said pontoon having a front end and a rear end, a substantially straight top surface, a fully curved rocker bottom surface, said top and bottom surfaces extending from said front ends of said pontoons to rear ends of said pontoons;

an inflatable transom interconnecting said rear ends of said pontoons, said transom extending above the top surfaces of said pontoons and having a rear surface extending from a top of said transom downwardly to said fully curved rocker bottoms of said pontoons and a front surface extending downwardly from said top of said transom to said top surfaces of said pontoons, said transom being inflatable with said pontoons;

a rigid platform secured between the pontoons and forwardly of the transom, said rigid platform projecting from a rigid frame secured between said pontoons and including means for positioning said frame between said pontoons; and a seat on said frame, said seat being forwardly of said platform.

4. A unitary twin pontoon hull float boat as in claim 3, wherein the rigid frame further includes a rigid standing deck movable between a stowed position beneath the seat and a use position extending forwardly from beneath said seat.

5. A unitary twin pontoon hull float boat as in claim 4, further including a safety bar; and means mounting said safety bar to be moved between a stowed position behind the seat and a use position forward of and above the rigid deck.

* * * * *